US006553671B2

(12) United States Patent
Blanchard

(10) Patent No.: US 6,553,671 B2
(45) Date of Patent: Apr. 29, 2003

(54) FOLDING KNIFE WITH A BUTTON RELEASE LOCKING LINER

(76) Inventor: Gary R. Blanchard, 3507 S. Maryland Pkwy., #E, Las Vegas, NV (US) 89109

( * ) Notice: Subject to any disclaimer, the term of this patent is extended or adjusted under 35 U.S.C. 154(b) by 195 days.

(21) Appl. No.: 09/732,664

(22) Filed: Dec. 8, 2000

(65) Prior Publication Data

US 2001/0023541 A1 Sep. 27, 2001

Related U.S. Application Data

(60) Provisional application No. 60/169,710, filed on Dec. 8, 1999.

(51) Int. Cl.[7] ..... B26B 1/04
(52) U.S. Cl. ..... 30/161; 30/331
(58) Field of Search ..... 30/160, 161, 331; 7/118–120

(56) References Cited

U.S. PATENT DOCUMENTS

| | | | |
|---|---|---|---|
| 4,170,061 | A | 10/1979 | Henry |
| 4,173,068 | A | 11/1979 | Cargill |
| 4,240,201 | A | 12/1980 | Sawby et al. |
| 4,274,200 | A | 6/1981 | Coder |
| 4,535,539 | A | 8/1985 | Friedman et al. |
| 4,541,175 | A | 9/1985 | Boyd et al. |
| 4,750,267 | A | 6/1988 | Boyd |
| 4,901,439 | A | 2/1990 | Boyd, Jr. |
| 4,947,552 | A | 8/1990 | Barnes |
| 4,985,998 | A | 1/1991 | Howard |
| 5,092,045 | A | 3/1992 | Boyd, Jr. et al. |
| 5,093,995 | A | 3/1992 | Jan |
| 5,461,786 | A | 10/1995 | Miller |
| 5,964,035 | A | 10/1999 | Poehlmann |

FOREIGN PATENT DOCUMENTS

| | | | |
|---|---|---|---|
| GB | 549428 | * 11/1942 | ..... 30/160 |

* cited by examiner

*Primary Examiner*—Douglas D. Watts
(74) *Attorney, Agent, or Firm*—Shook, Hardy & Bacon L.L.P.

(57) ABSTRACT

The present invention is an improved folding knife having a handle with opposing first and second sides and a rotatable blade coupled with the handle and moveable between a locked position at which the blade extends from the handle and an unlocked position. A slot is defined in the blade. A locking bar is coupled with the first side of the handle and has a free end biased toward the blade. The free end of the locking bar is received within the slot when the blade is in the locked position. An actuator member is disposed within the slot and is moveable with respect to the sides of the handle when the blade is in the locked position. The free end of the locking bar is forced from the slot of the handle when the actuator member is moved toward the first side of the handle so that the blade is rotatable to the unlocked position.

20 Claims, 3 Drawing Sheets

FOLDING KNIFE WITH A BUTTON RELEASE LOCKING LINER

CROSS REFERENCED TO RELATED APPLICATIONS

The present application claims priority of Provisional Application No. 60/169,710 filed Dec. 8, 1999.

STATEMENT REGARDING FEDERALLY SPONSORED RESEARCH OR DEVELOPMENT

Not applicable.

BACKGROUND OF THE INVENTION

The present invention relates to a folding knife and, more particularly, to a folding knife having a button release locking liner with a floating actuator member.

Folding knives typically have a locking mechanism to maintain the blade in the open position. One common locking mechanism employs a locking bar located within the space between the sides of the handle. The locking bar extends from one of the handle liners. When the blade is not in the fully open position, the free end of the locking bar is biased against the side surface of the tang of the knife blade. When the blade is rotated to the open position, the tang of the blade is cleared from the locking bar allowing the locking bar to move inwardly. At this point, the end of the lock bar abuts the end of the tang to prevent rotation of the blade.

Typically, a relief area is provided on the side of the handle opposite the lock bar to allow the user to deflect the lock bar toward the first liner, and unlock the blade from the open position. However, the relief area oftentimes compromises the line flow of the knife results in an unsightly and undesirable knife.

A number of attempts have been made to overcome the aesthetic shortcomings attributable to relief areas. For instance, some knives have utilized buttons that deflect the lock bar when depressed. However, the surface of the buttons oftentimes rises well above the surface of the knife handle and is also unattractive. Other attempts to solve the problem of unsightly relief areas or raised buttons have resulted in more aesthetically pleasing knives, but involve complex designs that are costly to produce, difficult to operate, or both.

BRIEF SUMMARY OF THE INVENTION

The present invention is an improved folding knife having a handle with opposing first and second sides and a rotatable blade coupled with the handle and moveable between a locked position at which the blade extends from the handle and an unlocked position. A slot is defined in the blade. A locking bar is coupled with the first side of the handle and has a free end biased toward the blade. The free end of the locking bar is received within the slot when the blade is in the locked position. An actuator member is disposed within the slot and is moveable with respect to the sides of the handle when the blade is in the locked position. The free end of the locking bar is forced from the slot of the handle when the actuator member is moved toward the first side of the handle so that the blade is rotatable to the unlocked position.

By providing a folding knife in accordance with the present invention, several advantages are realized. For example, the lines of the knife along the surfaces of the handle are largely uncompromised. Moreover, the folding knife of the present invention requires a relatively small slot in the blade, and does not weaken blade. The button can be nearly coplanar with the surface of the knife handle so as not to disturb the flowlines of the knife and allow for uninterrupted ornamentation on the handle at the juncture of the handle and button. Dangerous pinch points between the knife components and the user's fingers are also avoided. Not only is the knife easy to use, but the knife is simpler and less expensive to produce than other knives having similar aesthetic appeal.

BRIEF DESCRIPTION OF THE SEVERAL VIEWS OF THE DRAWING

The present invention is described in detail below with reference to the attached drawing, wherein.

DETAILED DESCRIPTION OF THE INVENTION

Figure 1:
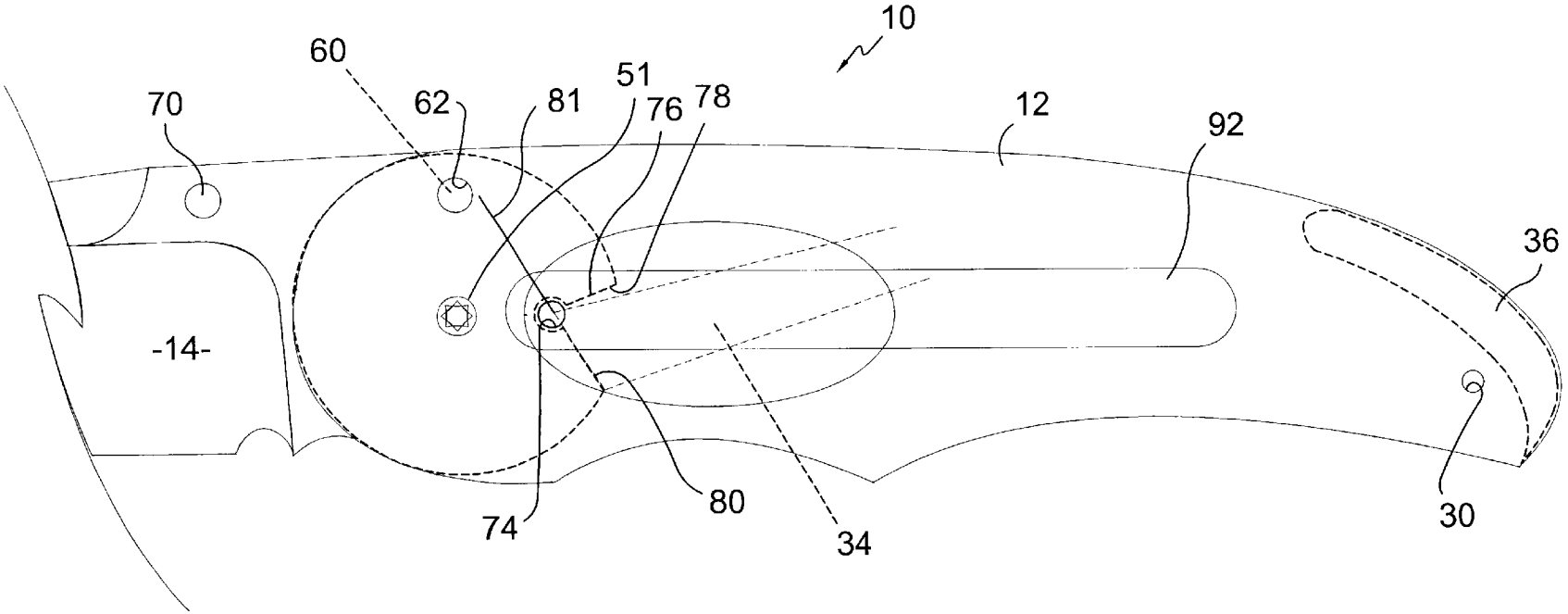
FIG. 1 is a fragmentary side elevational view of a folding knife of the present invention with the blade in the locked position.

A folding knife in accordance with the present invention is illustrated in FIG. 1 and broadly designated by numeral 10. Knife 10 includes a handle 12 and a blade 14 rotatable with respect to the handle between a closed position where the blade is housed within the handle and an open position as shown in FIG. 1 in which the blade extends from the handle.

Figure 2:
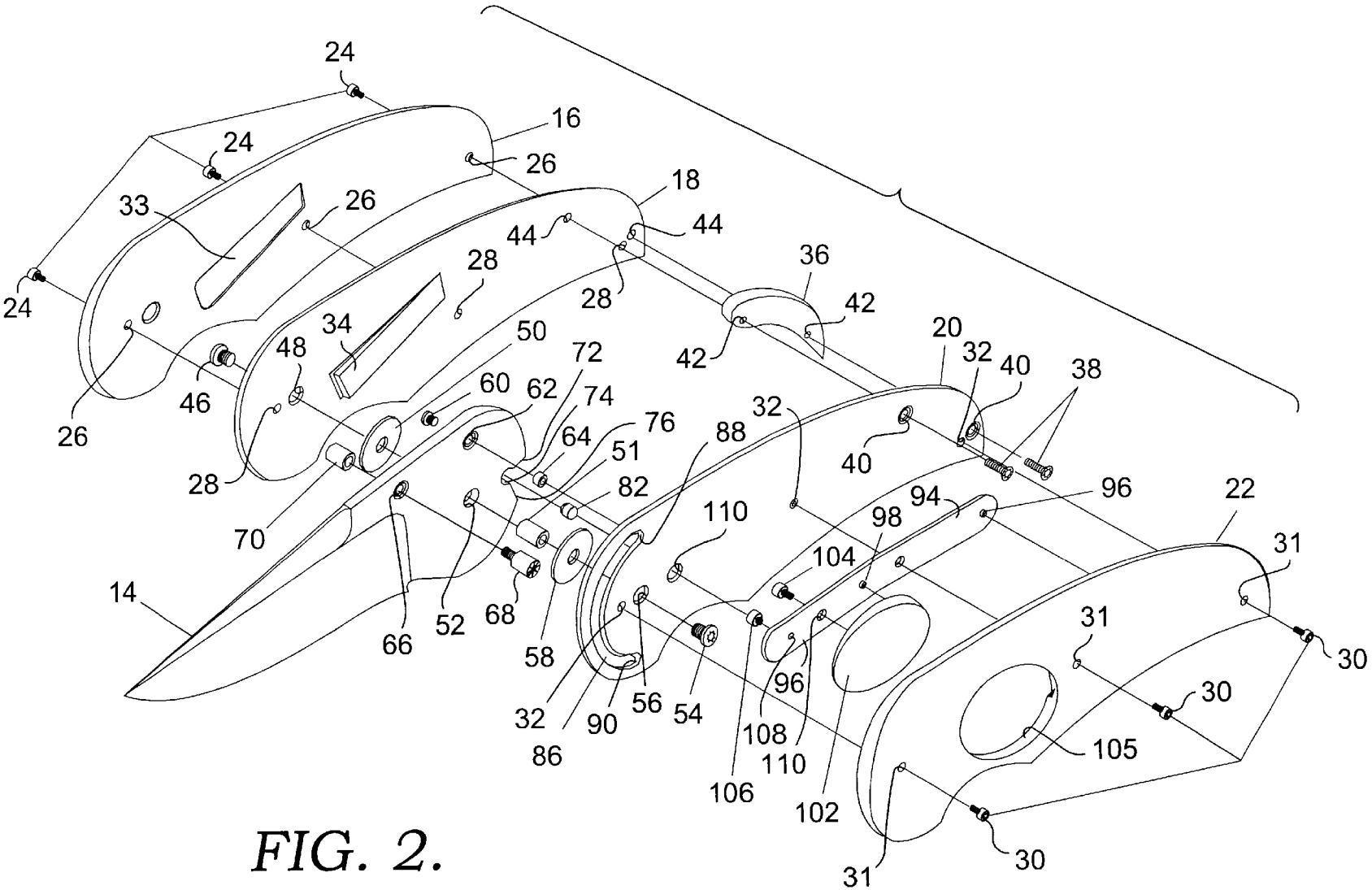
FIG. 2 is an exploded perspective fragmentary view of the folding knife of FIG. 1.

With reference to FIG. 2, the handle 12 includes a rear scale 16 and a rear liner 18 on one side of the blade 14, and a front liner 20 and a front scale 22 on the opposing side of the blade. A number of assembly screws 24 are placed within apertures 26 located within the rear scale 16, and matching apertures 28 within the rear liner 18, to hold the rear liner and rear scale to one another. Similarly, a number of assembly screws 30 are placed within apertures 31 and 32 in the front scale and front liner, respectively, to hold one to another. The liners are preferably formed of a light metal such as stainless steel and the scales are formed of conventional knife materials such as plastic or wood.

The inner face of rear scale 16 defines a slightly rectangular recessed area 33. A locking bar 34 is coupled with the rear liner 18, and, preferably, is formed integrally with the liner. The locking bar 34 is angled with respect to the length of the handle, as illustrated by the hatched lines in FIG. 1. Specifically, the locking bar 34 angles downwardly as it extends toward the front of the knife and terminates in a flat surface. Preferably, width of the locking bar 34 is more broad at its terminal end than at its inception. When the rear scale and rear liner are secured to one another, the locking bar 34 is aligned with the recessed area 32 to allow movement within the recessed area. The free end of the locking bar presents a rectangular surface.

The rear liner 18 is secured to the front liner 20 at the rear of the knife 10 by a backstrap 36 having a surface generally corresponding to the matching rear surfaces of the liners. A pair of assembly screws 38 are placed within a pair of apertures 40 in the front liner 20, through corresponding apertures 42 in the backstrap 36, and into a pair of apertures 44 in the rear liner 18. At the front of the knife 10, the blade 14 is secured between the rear liner 18 and front liner 20 by a rear pivot pin 46 and a front pivot pin 54. The pivot pin 46 is placed through a hole 48 in the rear liner 18 and within a pivot bushing 51 placed within the pivot hole 52 at the tang of blade 14. A rear washer 50 is placed about the bushing 51. Similarly, the front pivot pin 54 is placed through a hole 56 in the front liner 20 and within the pivot bushing 51. A front washer 58 is placed about bushing 51.

At the top edge of the tang of the blade 14, a rotary stop pin screw 60 is placed through an opening 62 and threaded into a rotary stop pin screw 64. At a distance from opening 62, another opening 66 is located along the top edge of the blade. A thumb bob 68 is placed through the opening 66 and threaded within an opposing thumb bob 70.

With reference to FIGS. 1 and 2, at the tang of blade 14, a slot 72 is defined. The slot has a central circular portion 74 and a mouth portion 76. The circular portion is preferably in longitudinal alignment with the pivot hole 52. Also, the end of the locking bar 34 is aligned with and overlaps the circular portion when the knife is assembled to allow the locking and unlocking of the blade as discussed below. With particular reference to FIG. 1, the mouth portion 76 has a first face 78 disposed at an angle with respect to a second face 80. Also, as shown in FIG. 1, the face 80 is preferably in alignment with the line extending from the center of circular portion 74 to the tangent of the opening 62 within which the rotary stop pin screw 60 is placed. When the blade is in the locked position illustrated in FIGS. 1 and 3, the end of locking bar 34 abuts the second face 80 of slot 72 to prevent rotation of the blade toward the handle.

Figure 3:
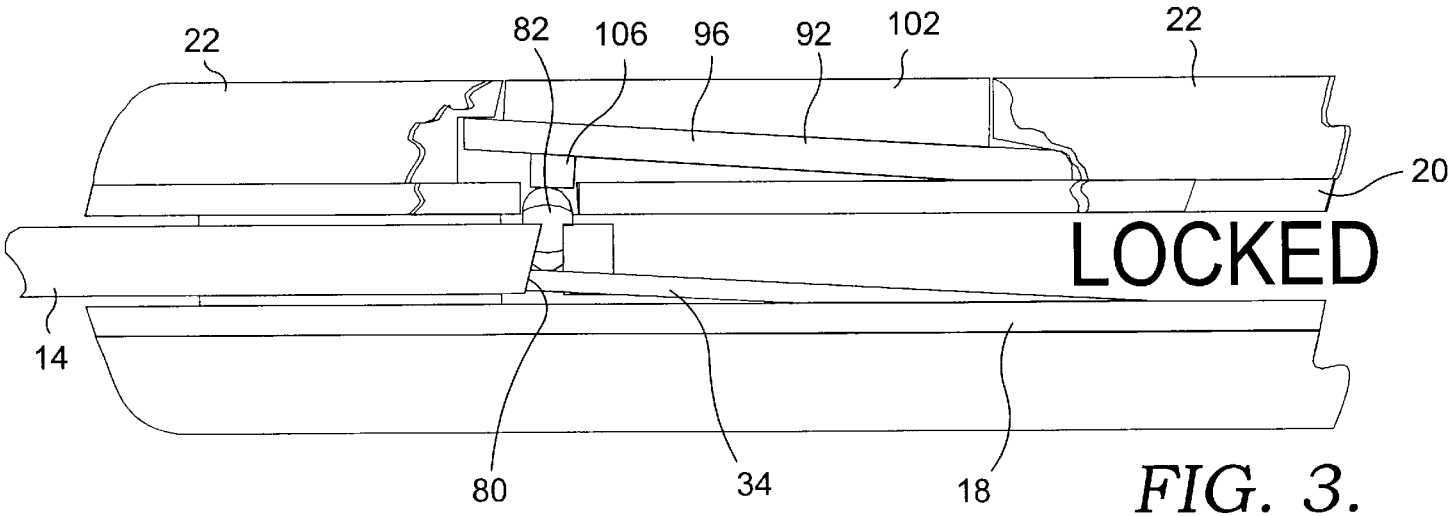
FIG. 3 is a fragmentary bottom perspective view of the folding knife with a portion of the front scale and front liner broken away to illustrate the blade in the locked position.
Figure 4:
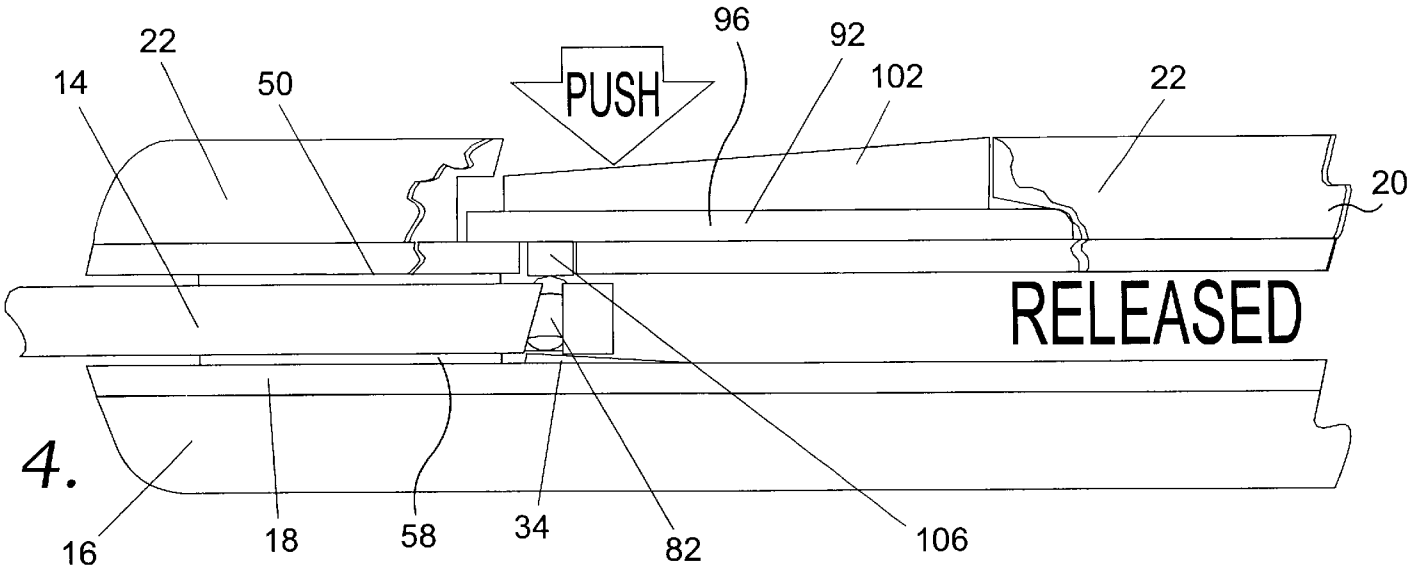
FIG. 4 is a fragmentary bottom perspective view of the folding knife of FIG. 3 with parts broken away illustrating the blade released from the locked position and rotatable with respect to the handle.

An actuator member 82 (or actuator extension) is placed within the circular portion 74 of slot 72. The mouth portion 76 narrows to a point to retain the actuator member with the circular portion of the slot. Preferably, the actuator member has a cylindrical body with a diameter slightly smaller than the diameter of the circular portion 74 of slot 72, and is rounded on either end (FIGS. 3 and 4). The roundness of the ends helps to move the actuator member within the port defined by the circular portion 74 when the knife is rotated from the locked position as described below. Alternatively, the actuator member could be spherical or take the form of any of a number of shapes that allow the member to move with respect to the slot as described below.

The front liner 20 has an aperture 84 that is aligned with the circular portion 74 of slot 72. A rotary slot 86 is defined within the front liner 20 at a radial distance equal to the distance between the pivot hole 52 and the opening 66 at which the rotary stop pin screws 60 and 64 are secured. Thus, the rotary stop pin screw 64 extends within the slot 72 when the knife is assembled. The rotary slot defines a semicircular arc terminating at a first end 88 and a second end 90 to limit rotation of the blade as described below.

A spring bar 92 is secured between the front liner 20 and front scale 22. The spring bar has a rear portion 94 and a front portion 96 angled in the direction of the front scale. The rear portion 94 is fixedly secured to the inside of the front scale 22. Preferably, on the face of front scale 22 directed toward front liner 20, a slotted relief area (not shown) is defined, and the rear portion 94 is fit within the area. If the relief area is not milled with sufficient precision to prevent lateral movement of the rear portion 94 within the relief area, small bores (not shown) may be drilled for alignment and receipt a pair of alignment pins 96 and 98.

On the front portion 96 of the spring bar, a button 102 is secured to the outside of the bar by a button mount screw 104 placed through an aperture 106 and into an threaded aperture (not shown) in button 102. The spring bar is preferably made of stainless steel or a similar metal. If needed, the button may be secured to the spring bar by at least one other button mount screw. When the knife is assembled, the front portion of the spring bar is biased toward the front scale, and the button extends through a button hole 105 located in front scale 22. Button hole 105 is typically nearly the same shape and size as the button 102. The button is preferably oval shaped, however, buttons of various shapes and sizes may be used in accordance with the present invention.

An actuator contact member 106 is secured to the spring bar at an aperture 108 in the front portion 96. The actuator contact member 106 is preferably cylindrical and has a diameter equal to that of the actuator member 82. The actuator contact member is positioned so that it is in axial alignment with an opening 110 in the front liner 20. The opening 110 is positioned at a distance that is closer to the hole 56 (aligned with pivot hole 52) than the radial distance from the hole 52 to the rotary slot 86. Also, the opening 110 is wider than the diameter of the member and is aligned with the actuator member 82 to allow contact between the actuator member and actuator contact member as described below.

In operation, the blade 14 may be rotated from a position wherein the blade is housed between the liners 18 and 20 to a locked position wherein the blade extends longitudinal from the handle 12 (FIG. 1). In the closed position, the rotary stop pin 64 abuts the second end of rotary slot 86. This prevents the edge of the blade 14 from contacting the backstrap 36 and damaging the blade surface. When in the closed position, the locking bar 34 is held against the side of the tang of blade 14, since the deflection of the locking bar 34 biases the bar toward the blade. Also, in this position, the actuator member 82 is centered within the circular portion 74 of slot 72 between the opposing liners 18 and 20.

To open the blade, a user grasps the thumb bobs 68 and 70 and pulls the blade from the closed position. As the blade rotates about the pivot hole 52, the rotary stop pin 64 travels along the rotary slot 86. The actuator member 82 is held within the port defined by circular portion 74 and the rounded ends of the member 82 slides on the surfaces of liners 18 and 20 to maintain the position of the member 82 between the liners. The distance between the pivot hole 52 and circular portion 74 is equal to the distance between the aperture 56 and opening 110 on the front liner—and less than the radial distance between the rotary slot 86 and aperture 56 on the front liner. Accordingly, as the actuator member 82 floats about the pivot point, the actuator member 82 does not displaced into the rotary slot 86.

With particular reference to FIG. 3, when blade extends to the open position, the rotary stop pin 64 abuts the first end 88 of the rotary slot 86. The actuator member 82 becomes aligned with opening 110 in the front liner 20 and the locking bar 34 slides from the side of the tang of the blade 14 and into abutment with the second face 80 of slot 72. As the locking bar 34 slides from the side of the blade into abutment with the face of the slot, the bar 34 forces the actuator member 82 axially with respect to the blade 14 and into opening 110 of front liner 20. The actuator member 82 contacts the actuator contact member 106 and pushes the front portion 96 of spring bar 92 away from the blade. In this position, the locking bar prevents rotation of the blade relative to the handle 12.

With particular reference to FIG. 4, to unlock the blade, button 102 is depressed. As the front portion 96 of spring bar 92 is deflected toward the blade, the actuator contact member 106 engages actuator member 82 and pushes the end of locking bar 34 from the mouth portion 76 of slot 72. When the button 102 is depressed, the locking bar is cleared from the end of the blade 14, and the user may rotate the blade toward the handle 12. Once the blade is rotated slightly from the open position, pressure from the button 102 may be removed and the blade moved to the stored position between the opposing liners. The actuator member 82 remains within the port defined by the circular portion 74 of the slot as the blade is rotated relative to the handle.

The present invention provides numerous advantages. For instance, very little displacement of the actuator member is needed. This allows the button to be placed nearly coplanar with the surface of the handle to present a smooth surface. No pinch points are encountered when operating the locking mechanism and the integrity of the blade is not compromised. Likewise, the knife is very easy to operate without sacrificing performance. Namely, the blade may be safely and precisely locked and unlocked with a simple operation of the button. Unlike prior knives, not only is the knife of the present invention easy to operate, it is relatively inexpensive to construct.

From the foregoing, it will be seen that this invention is one well-adapted to obtain all the needs and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

What is claimed is:

1. A folding knife comprising:

a handle, said handle having opposing first and second sides;

a blade rotatably coupled with said handle and moveable between a locked position wherein said blade extends from said handle and an unlocked position, said blade defining a slot;

a locking bar coupled with said first side of said handle, said locking bar having a free end biased toward said blade wherein said free end is received within said slot when said blade is in said locked position, and an actuator member disposed within said slot of said blade and moveable with respect to said sides of said handle, said actuator member disposed between said locking bar and said second side of said handle when said blade is in said locked position, wherein said free end of said locking bar is forced from said slot of said blade when said actuator member is moved toward said first side of said handle so that said blade is rotatable to the unlocked position.

2. A folding knife as recited in claim 1, wherein said actuator member is in said slot when said blade is in said unlocked position.

3. A folding knife as recited in claim 2, further comprising a button coupled with said second side of said handle whereby said actuator member is moved toward said first side of said handle when said button is depressed.

4. A folding knife as recited in claim 3, wherein said button is coupled with said second side of said handle by a spring bar.

5. A folding knife as recited in claim 4, wherein said spring bar has a first portion coupled with said second side of said handle and a second portion coupled with said button, wherein said second portion is biased away from said blade.

6. A folding knife as recited in claim 3, further comprising an actuator contact member secured to said button, said actuator contact member aligned with said actuator member when said blade is in said locked position, and wherein said actuator contact member forces said actuator member toward said first side of said handle so that said blade is rotatable to the unlocked position when said button is depressed.

7. A folding knife as recited in claim 1, wherein said slot has a first portion and a second portion, said first portion holding said actuator member, said second portion presenting at least one face wherein said locking bar abuts said face when said blade is in said locking position to prevent rotation of said blade.

8. A folding knife as recited in claim 7, wherein said actuator member includes opposing first and second ends, at least one of said ends presenting a rounded surface.

9. A folding knife as recited in claim 7, wherein said second side includes a liner, said liner defining a rotary slot having a first end and a second end.

10. A folding knife as recited in claim 9, further comprising a rotary stop pin secured to said blade, said rotary stop pin projecting within said rotary slot of said liner wherein said rotary stop pin contacts said first end of said slot when said blade is in said locked position and said second end of said slot when said blade is rotated to a position between said sides of said handle.

11. A folding knife comprising:

a handle, said handle having opposing first and second sides;

a blade rotatably coupled with said handle and moveable between a locked position wherein said blade extends from said handle and an unlocked position, said blade defining a slot;

a locking bar coupled with said first side of said handle, said locking bar having a free end generally aligned with and moveable with respect to said slot wherein said free end is received within said slot when said blade is in said locked position, and an actuator member disposed within said slot of said blade and moveable with respect to said locking bar, said actuator member partially disposed within said second side of said handle when said blade is in said locked position, wherein said free end of said locking bar is forced from said slot of said blade when said actuator member is moved toward said locking bar so that said blade is rotatable to the unlocked position.

12. A folding knife as recited in claim 11, wherein said actuator member is in said slot when said blade is in said unlocked position.

13. A folding knife as recited in claim 11, further comprising a button coupled with said second side of said handle whereby said actuator member is moved toward said first side of said handle when said button is depressed.

14. A folding knife as recited in claim 13, wherein said button is coupled with said second side of said handle by a spring bar.

15. A folding knife as recited in claim 14 wherein said spring bar has a first portion coupled with said second side of said handle and a second portion coupled with said button, wherein said second portion is biased away from said blade.

16. A folding knife as recited in claim 13, further comprising an actuator contact member secured to said button, said actuator contact member aligned with said actuator member when said blade is in said locked position, and wherein said actuator contact member forces said actuator member toward said first side of said handle so that said blade is rotatable to the unlocked position when said button is depressed.

17. A folding knife as recited in claim 11, wherein said slot has a first portion and a second portion, said first portion holding said actuator member, said second portion presenting at least one face wherein said locking bar abuts said face when said blade is in said locking position to prevent rotation of said blade.

18. A folding knife as recited in claim 17, wherein said actuator member includes opposing first and second ends, at least one of said ends presenting a rounded surface.

19. A folding knife as recited in claim 18, wherein said second side includes a liner, said liner defining a rotary slot having a first end and a second end.

20. A folding knife as recited in claim 19, further comprising a rotary stop pin secured to said blade, said rotary stop pin projecting within said rotary slot of said liner wherein said rotary stop pin contacts said first end of said slot when said blade is in said locked position and said second end of said slot when said blade is rotated to a position between said sides of said handle.

* * * * *